United States Patent [19]

Keller

[11] 4,260,481

[45] Apr. 7, 1981

[54] SIFTING DEVICE

[75] Inventor: Alois Keller, Uzwil, Switzerland

[73] Assignee: Gebrueder Buehler AG, Uzwil, Switzerland

[21] Appl. No.: 27,248

[22] Filed: Apr. 5, 1979

[30] Foreign Application Priority Data

May 2, 1978 [CH] Switzerland ..... 4754/78

[51] Int. Cl.[3] ..... B07B 1/38

[52] U.S. Cl. ..... 209/315; 209/366.5; 209/415

[58] Field of Search ..... 209/315, 319, 366, 366.5, 209/332, 370, 373, 325, 329, 326, 415, 339, 508; 210/323 R

[56] References Cited

U.S. PATENT DOCUMENTS

| | | | |
|---|---|---|---|
| 2,723,751 | 11/1955 | Conkling | 209/319 |
| 2,865,506 | 12/1958 | Velke | 209/315 |
| 3,815,741 | 6/1974 | Keller | 209/319 |
| 4,062,768 | 12/1977 | Elliott | 209/1 |

FOREIGN PATENT DOCUMENTS

| | | | |
|---|---|---|---|
| 256826 | 3/1912 | Fed. Rep. of Germany | 209/366 |
| 855043 | 9/1952 | Fed. Rep. of Germany | 209/332 |
| 858794 | 10/1952 | Fed. Rep. of Germany | 209/415 |
| 2053290 | 5/1972 | Fed. Rep. of Germany | 209/366.5 |
| 391766 | 9/1908 | France | 209/366 |
| 478501 | 9/1915 | France | 209/366 |
| 21013 | of 1912 | United Kingdom | 209/366.5 |
| 717089 | 7/1952 | United Kingdom | 209/332 |
| 987673 | 3/1965 | United Kingdom | 209/366 |
| 882211 | 10/1974 | U.S.S.R. | 209/315 |

*Primary Examiner*—Robert Halper

*Attorney, Agent, or Firm*—Merchant, Gould, Smith, Edell, Welter & Schmidt

[57] ABSTRACT

An improved plansifter having an open trough-shaped housing (12) on which is centrally mounted an oscillation generator having a drive motor (40) and a rotary and balance weight (41) for imparting oscillation movement to the housing (12). A pair of sieve stacks (23), each having a plurality of individual sieves (4), is mounted on the floor (16) of the housing (12) stradling the oscillation generator. The housing (12) is suspended for free oscillation. In a preferred construction, the rotary unbalance weight (41) is accelerated by the drive motor (40) to operational speed in a short period of time in order to preclude adverse resonance effects. The deleterious effects which might occur to the structure as it goes through its resonance frequency during acceleration and deceleration of the rotary unbalance weight (41) can be further minimized by providing a suspension means comprising an elastic suspension element (26) at one of four positions on the housing (12). Each element (26) may include a plurality of circularly cylindrical plastic bars (25) extending parallelly from a point or locus of affixation on the housing (12). In one preferred embodiment, first and second ends of the bars (25) can be secured at the point or locus of affixation to the housing (12) and an external support (22) respectively by means of a plurality of facing clamping members (27, 28, 29) with facing clamping surfaces having contours (31) formed therein to accommodate and securely retain therebetween the plastic bars (25).

8 Claims, 11 Drawing Figures

SIFTING DEVICE

TECHNICAL FIELD

The invention of this application relates to plansifters, and more particularly, to plansifters mounted or intended to be mounted for free oscillation and which have two neighboring sieve stacks.

BACKGROUND OF PRIOR ART

The plansifter is one of the few machines which, for nearly a hundred years, has withstood all attempts made by inventive ingenuity to replace it. Still utilizing the same basic technique, it remains unsurpassed for certain uses in mills, namely producing and grading individual products of grinding operations such as baking flour, semolina, etc.

The entire plansifter mechanism is given a horizontal circulating movement which not only allows the actual sifting work to be carried out but also conveys the product from sieve to sieve and to outlets. The mounting and drive of the plansifter can be of such a construction that the plansifter operates as either a freely oscillating apparatus or a positive drive device constrained in its movements.

One of the disadvantages of positive drive, particularly in large plansifters, is the provision of guides required for the positive drive. The mechanism necessarily includes a crank drive which has attendant lubrication and maintenance problems. In the case of positive drive sifters more oscillation forces are transmitted outward from the device than in a freely oscillating plansifter. It is desirable, therefore, that plansifters be designed so that they do not suffer damage when operational disturbances occur, even if the sifters remain in operation partly or completely filled with grinding products.

If the present market situation is considered, it will be noted that there has been a certain standardization of plansifters. Large plansifters which are usually constructed as freely oscillating sifters are, numerically, clearly the dominant machine. The second most frequently used are small plansifters constructed as positive drive sifters having only a single open stack of sieves.

Medium size sifters which usually utilize two sieve compartments or stacks are used relatively infrequently. Suggested reasons for this include high price, inadequate economic advantages, and constructional defects. It has been difficult, however, to specifically identify one predominant reason.

It is recognized in the technical world that the running-up and running-down periods of a freely oscillating plansifter not utilizing an outside drive shaft do not occur free of resonance. Using the formula $w^2=g/l$ (wherein l is the length of the pendulum suspension) the angular velocity or resonance range can be estimated, and values are generally calculated, for example, where the range of the rotational speed of the unbalance is about 10–30 rpm. The operational speed of the unbalance in most cases is far above these values, but a freely oscillating plansifter has to pass through this critical resonance range when running-up and running-down.

In large plansifters resonance problems are greatly reduced since they have a large number of inlets and outlets or other points of connection securing the device to parts of the structure or building in which the device is housed. This construction has an inhibiting effect on any excessive outward throw of the plansifter.

The situation is rather different with a single stack sifter. Factors stimulating resonance are more pronounced than for large plansifters. For example, the mass of material being sifted in control sifting may be a much larger percentage of the total weight of the plansifter. Mechanical problems are also increased by fluctuating weights and center of gravity positions. In a single-stack sifter a compromise has to be struck between constructional design, access to replacement of sieves, and the arrangement of the unbalance. It has generally been found that, regarding forces such as those caused by resonance, compromise is very dangerous and often leads to serious damage. One solution has been to use the positive drive construction for small or single-stack sifters. To a degree, such construction allows the dangerous resonance ranges to be avoided or cut out in all working conditions. However, with a single-stack sifter, the number of stacked sieves has had to be limited to between 6 and 9 since, if more were used, wobble or run out forces would prejudice operational safety and reliability. The number of possible separations in a single-stack sifter is usually between 2 and 6, and stacks of sieves whose overall surface is smaller are used.

Operational experience over many decades has proven the effects described above for various sized plansifters. Since the freely oscillating apparatus is not suitable for small sifters, and conversely positive drive has not been found very suitable for large plansifters, the engineer has been presented with the difficult task of deciding what design is best for the medium sized, two-stack sifter.

BRIEF SUMMARY OF THE INVENTION

It is with these problems that the invention of the present application is concerned. An objective is to provide an improved plansifter which allows a two-stack sifter to be constructed in a simple manner, to operate satisfactorily and safely, and yet have a long working life. There have been many attempts to solve these difficulties in the past. But heretofore, the solutions proposed have always failed on basic points. Thus, for example, in the case of a two-stack positive drive sifter it has not been possible to use more sieves or a larger screening surface than with two single-stack sifters. The large plansifter reduced to a two-stack sifter is no longer acceptable because of costs involved with the required frame and housing construction. Two stacks of sieves, one situated above the other, result in cumbersome operation of the sifter.

Applicant's invention provides a medium-size free-oscillating plansifter comprising two neighboring sieve stacks and an oscillation generator having a drive motor and a rotary unbalance weight. The oscillation generator can be mounted between the sieve stacks to oscillate with the housing. The disposition and arrangement of the parts is such that the resultant horizontal force of the unbalance is effective approximately at about the region of the center of gravity of the plansifter. The drive means for the circulating unbalance is able, and is substantially arranged, to perform the running-up phase and the running-down phase quickly. By a medium size plansifter, is envisioned one in which the sieves in each stack number not less than 6 nor more than 18 but, more preferably, less than 15 and even less than 12. Its run-up period does not take longer than 5 seconds or thereabouts. The run-down phase may take longer, but preferably not more than 10 seconds or thereabouts. Optimum run-up will be completed within about 1 to 2 seconds and run-down within 2 to 5 seconds. Preferably both are performed within 4 seconds.

In a preferred construction, the plansifter housing is constructed symmetrically and, in the region of the sieve stacks, as an upwardly open trough (carrier, tray or frame) into which the sieve stacks can be placed. This allows for easy changing of the sieves, inspection, etc. The general center of gravity is located low in the device, and consequently, it is found that the plansifter has a particularly quiet behavior in all operating states likely to occur in actual practice.

In order to allow for different sifting tasks, individual sieves larger than ones known in the art may be used or, instead of individual large sieves, an appropriate number of small sieves can be used in each stack. The fundamental relative arrangement of stacks and unbalance should be retained however, and the running-up and running-down phases should be passed through quickly.

In a preferred embodiment, the drive motor for the unbalance can be secured proximate the center of the trough floor. Functionally, constructionally and operationally, there are great advantages when using the following features.

The lateral walls of the trough surround only the lower half of the highest stack of sieves.

The unbalance and the drive are enclosed by the plansifter housing, the roof and bottom of which provide a drive casing about ⅔ the maximum height of the sieve stack. This means that if the smallest logical number of sieves is used, the stack and the drive casing are about the same height.

The lateral walls of the trough are constructed with vertical stack rails which extend to a height of ⅓–½ of the full stack height, and are arranged at the outer four corners of the plansifter. The trough shape is made sufficiently open to allow easy access to the stacks at the end of the trough.

The plansifter can be suspended, as has previously been done with large plansifters, as a freely oscillating body. This suspension may be effected by use of elastic bars. Preferably, four groups of such bars are attached to the plansifter housing one on either side of each stack near the lateral centers thereof. The groups of bars can be secured at a vertical point of attachment, depending on given space conditions, in either the region of the trough bottom or the vertical center of the stack.

It was generally felt that a first prototype constructed might wobble on its four supports to an extent that its working life would be short. It was thought that momentary overloading intensified by free flow of the material being sieved, which might naturally occur with two stacks arranged side-by-side, might result in fracture of the supports after only a short time; it was even felt that fracture might occur in the initial running-up phase. The plansifter, was constructed entirely without a constrained guide arrangement, safety cables and the like. Surprisingly, after nearly a year of continuous testing simulating working conditions, and even under overload conditions, the supports remained resilient.

It has not yet been determined with certainty what characteristics of the invention are responsible for this surprising success. It is considered important that each support comprises a plurality of individual bars. Additionally, it is thought that another important contribution to the success resides in the use of bars composed of plastic material. More preferably, plastic material bars reinforced with glass fiber or glass fiber bars can be used. A plurality of plastic material bars are combined to form a support, and the entire plansifter can be mounted on four elastic supports as a freely oscillating body.

The best configuration constructed has the upper point of affixation of the supports situated approximately in the horizontal plane in which the center of gravity lies, and in the center of the side of the stack.

It has been possible to overcome all doubts regarding the flow properties of plastic material by securing the plastic material bars above and below with clamps and constructing the clamps without pointed portions, but rather with the clamping surfaces formed with a contour the same as the round shape of the bars. Preferably the plastic supports are constructed as circularly cylindrical solid bars.

DETAILED DESCRIPTION OF THE INVENTION

Figure 1:
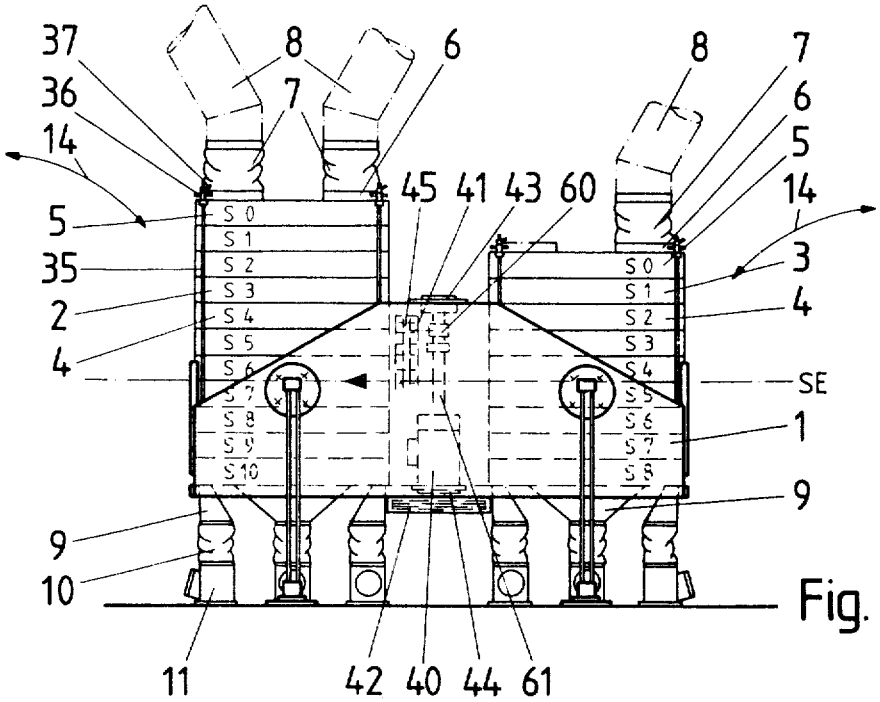
FIG. 1 is a front elevation of a plansifter with two stacks of sieves mounted as a freely oscillating body on four supports.
Figure 3:
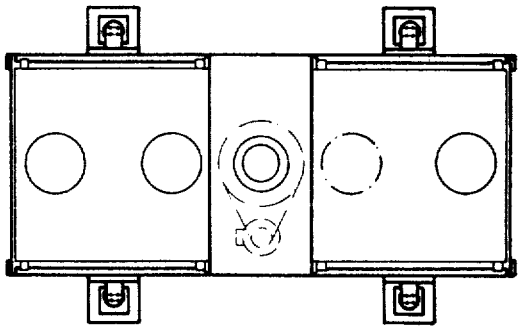
FIG. 3 is a diagrammatic plan view corresponding to FIG. 1.
Figure 2:
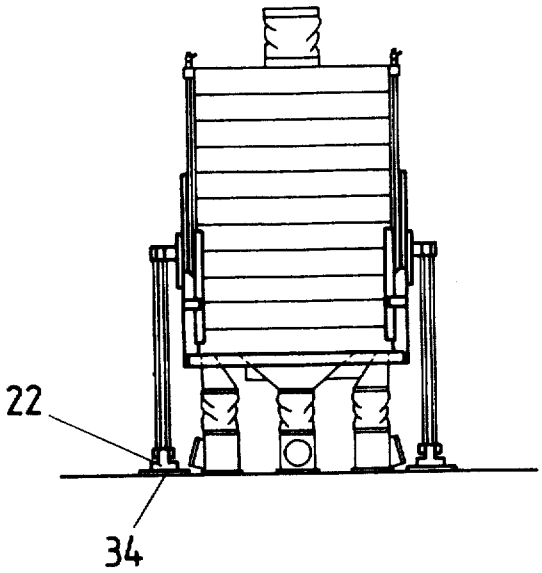
FIG. 2 shows the plansifter of FIG. 1 in side view.

FIGS. 1 to 3 show a sifting apparatus or, as it is known in the art, a plansifter which includes a left-hand stack of sieves 2 with individual sieves 4 numbered 1 to 10, and also a right-hand sieve stack 3 with sieves 4 numbered from 1 to 8. Both sieve stacks have an upper end element 5 with inlet union 6 these being connected by flexible sleeves 7 with appropriate product feed conduits 8. The individual products fractionated according to size issue from the lower end of the sieve stacks by way of outlets 9 which are also connected by flexible sleeves 10 to stationary outlet conduits 11.

The left-hand sieve stack 2 has for example two inlet unions 6 operating for the ten sieves 4, secured to the two sleeves 7 which are illustrated and the product feed conduits 8. The right-hand sieve stack on the other hand is supplied only with one product feed conduit 8. As a result there are different load conditions between the left-hand stack 2 and the right-hand stack 3.

Figure 4:
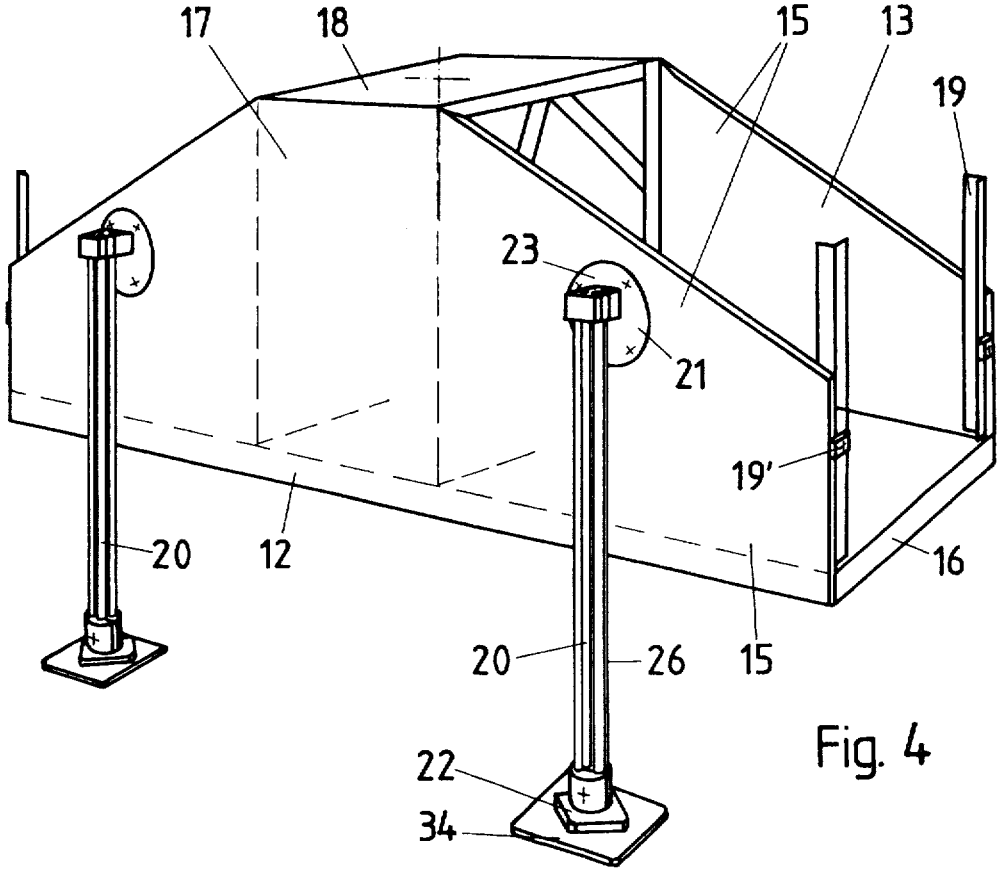
FIG. 4 shows the trough-shaped construction of the plansifter housing.

The illustrated plansifter housing 12 is not totally enclosing—it is rather simply a half housing which is shaped as a carriage 13 open topped in the region of the sieve stacks (FIG. 4). This makes it possible for the two stacks of sieves 2 and 3 to be fitted and removed as complete stacks into and from the carriage 13 in the directions of the arrows 14. The sieves may also be changed individually by hand in the same directions as shown by arrows 14.

Reference will now be made to FIG. 4 where there is shown in perspective a plansifter housing 12 constructed as a trough-shaped carriage 13. The plansifter housing 12 comprises longitudinal sides or side walls 15 and a continuous trough bottom 16. Two troughs formed for receiving the stacks of sieves are connected in the middle by a drive casing 17 which is formed above with the roof portion 18 and below with the bottom 16 to form a housing which gives the trough for necessary rigidity for oscillation. At the outer four corners there is also arranged in each case a generally vertical angle brace or stack holding rail 19, each being secured by a fixing screw 19'. The stack holding rail is also used for guiding so that the sieves, more particularly the lowest sieve, can be placed precisely at the correct location on the trough bottom 16. At the same time, the rail serves as a safety means in case the operator forgets, before starting the machine, to tighten an apparatus for clamping the sieves to the housing 12. The plansifter housing 12 is mounted on four elongated plastic elements or upright supports 20 which comprise resilient means for suspending the housing 12. The supports 20 are held at their upper ends by means of upper fixing elements 21 located at attachment loci on the side walls 15 of the housing 12, and also, at their bottom ends, by external supports or lower fixing elements 22 which can be placed directly on the floor.

Figure 5:
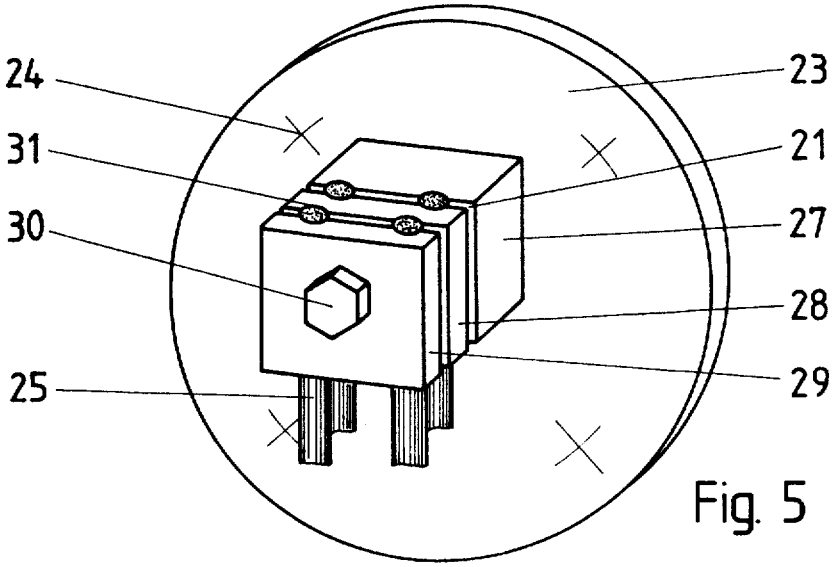
FIG. 5 shows a fixing detail of the elastic supports.

FIG. 1 to FIG. 4 and also FIG. 5 show details of the suspension arrangement. The upper fixing element 21 can be secured to the housing 12 by a large round flange 23 by means of four screws 24 to the side wall 15. This arrangement allows the upper fixing element to be attached directly to the plansifter housing 12 at attachment loci on the side wall 15.

Fatigue phenomena in the support material coming from the bearing arrangement have not been found to occur if the following suspension means is used. The upper fixing system is shown in FIG. 5 on a larger scale illustrating the construction with elongated elastic elements. Each of four circularly cylindrical plastic material bars 25 can be brought together and fixed as a suspension element 26, shown in FIG. 4, to fixing elements 21 above and 22 below respectively. It has been found advantageous to connect the fixing point rigidly at attachment points or loci on the plansifter housing 12 and at external supports which may be secured to the floor. For extreme cases such as, for example, relatively large travel circles defined by oscillation of the plansifter, it may be advantageous to give the fixing points a degree of elasticity. The fixing element 21 can be a three-part clamping assembly having a clamping plate 27, a central part 28 and a counter-plate 29 which are all adapted to be clamped together by a bolt or other fastening means 30. All the clamping members would have concave recesses 31 shaped to conform with the contour of the plastic material bars 25; that is to say the radii of the recesses 31 would be the same as the radii of the plastic material bars. Experience thus far has shown that the fixing of the plastic material bars has to be made with as much attention as is given the dimensions, the quality, and the internal structure of the plastic material bars themselves. The bar can comprise, internally, a very high percentage of glass fibers which extend in the longitudinal direction of the bar, and said fibres are embedded in special synthetic resin.

The plastic material bar has, in general, an elastic behavior similar to steel. Contrary to one easily formable misconception of arranging pointed elements comprising a series of serrations on the internal surface of the clamp such as is the case with plansifters known in the art which use bamboo or other similar tubular bars which serrations penetrate into the material of the bars, with these plastic material bars only a non-pointed clamping system has been found satisfactory; i.e. contour portions of the clamping members should be made to conform to the size and shape of the bars and be substantially smooth. This arrangement has not shown any flow problems or harmful shrinkage or expansion problems.

The external support or lower fixing element 22 might be constructed similarly to the element 21 since substantially the same forces occur. Here again there may be a three-part retaining means with a central supporting part and two outer elements. The fixing element 22 can be fixed to the floor by means of a foot 34 with sufficient stability. The four feet shown in FIG. 4 need not be connected to one another as has hitherto been the case with corresponding single-stack or two-stack sifters constructed as positive drive sifters. It has been found that, with the constructional form described, only a fraction of the oscillation forces are transmitted through the floor to the environment or to the building as compared with comparable positive drive sifters.

As FIG. 1 shows, the sieve stacks 2 and 3 project above the plansifter housing. The exact number of sieves is not basically limited by the inventive concept but rather because of the constructional dimensions and arrangement.

An economical number is about 10–15 sieves placed one above the other, and the surfaces of the individual sieves can be made substantially larger as compared with conventional positive drive sifters. The number of sieves in the stack may differ depending on specific sifting tasks which have to be carried out. After inserting the desired number of sieves the stacks are clamped by clamping rods 35 securely on to the trough. Clamping screws 36 and lock screws 37 are tightened securely when used to secure the clamping rods 35 to the trough. For changing the sieves the clamping bars 35 can be swung slightly to the side. The height of the drive casing 17 usually amounts to about $\frac{2}{3}$ the height of the largest sieve stack. This advantageous feature, for one thing allows the overall centre of gravity of the sifter to be kept down low, this being less than $\frac{1}{3}$ of the maximum sieve stack height for the plansifter housing without a stack.

For a like reason, the drive motor 40 is fixed to the continuous trough bottom 16 in the drive casing. Drive is transmitted from the motor 40 to the unbalance 41 preferably with direct belt pulleys 42 with belt drive below the continuous trough bottom 16. The drive motor could also be secured from below the trough bottom. The drive motor with full voltage starting (usually delta connection) in this way comes immediately to its nominal operational speed. This short acceleration period feature has been found advantageous for allowing passing through the dangerous resonance range sufficiently quickly.

It is desirable that the drive motor and the transmission should be brought to full rotational speed in about 1–2 sec, and in no more than twice that time should run through the region of the critical speed and be braked by means of, for example, a stop motor.

The unbalance 41 is mounted in bearings 43 and 44 on the roof and bottom of the drive casing. The unbalance can comprise an iron unbalance body 45 in which lead can be cast or screwed into fan-shaped hollows in order to form the desired unbalance mass and also position the resultant force of the unbalance. In this way the resultant force can be adjusted in a very simple manner to a point within a range of ¼—almost ½ of the height of the sieve stack. The entire constructional arrangement gives sufficient clearance to allow for aligning the resultant force of the unbalance for all cases likely to occur in practice, so that it is effective approximately in a horizontal plane SE containing the overall centre of gravity of the plansifter. Since the entire design is inherently trouble-free, small deviations of the centre of gravity position or the corresponding plane of action of the unbalance can be tolerated. This is to be expected of the plansifter. Practical requirements are satisfied by the plansifter in that mills will now require less supervision, more automation and generally fewer product changes; that is to say, it is worthwhile having very precise adaptation of the plane of action of the unbalance so that the plansifter is adjusted precisely in the empty state, i.e. with the largest number of sieves but without the product to be worked. Then in operation this sifter tolerates considerable deviations in the centre of gravity caused by the mass of product. In specific embodiments it is proposed to displace the unbalance 41 axially on the shaft 61 by means of clamping rings 60.

Constructionally and also in operation the trough shape of the plansifter housing affords very many advantages. The lateral trough walls in the preferred constructional form extend up only about half the height of the sieve stack. Accessibility and visual control are improved in that the side walls are constructed to taper downward away from the drive casing. The external stack holding rails 19 can be made to project somewhat above the side walls. This does not prejudice to any considerable extent either visual control or ease of attending to the machine. On the other hand this measure makes it possible for the centre of gravity of the stack of sieves to be situated at the most only slightly above the safety rails 19, and the stack itself, even if the tensioning arrangement, such as with clamping rods 35, has not been tightened or has not been sufficiently tightened, is not thrown out of the plansifter when the latter is started up.

Figure 9:
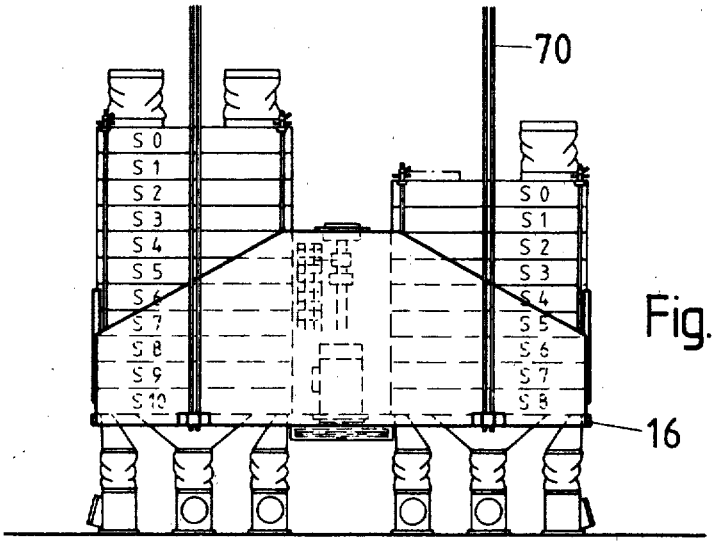
FIGS. 9 to 11 show in greater detail the plansifter of FIGS. 7 and 8 with its suspension mountings.
Figure 11:
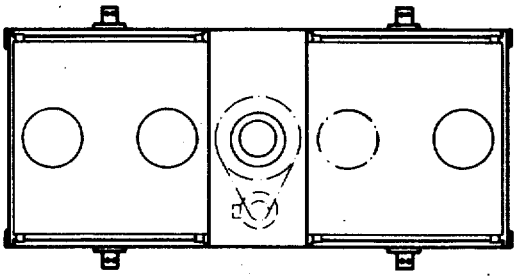
Figure 10:
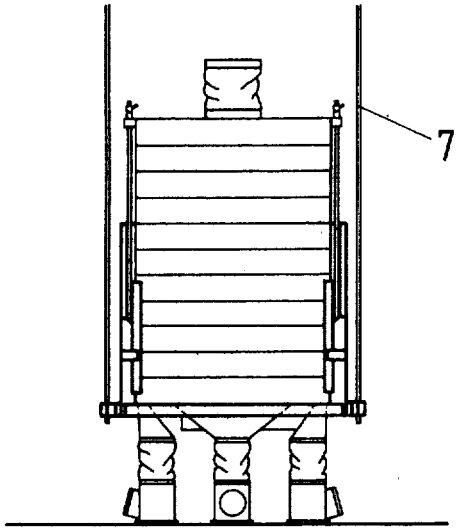

The plansifter can also be suspended by elastic bars 70 as shown in FIGS. 9, 10 and 11.

In the suspended constructional form the optimum solution for most purposes is to arrange the lower fixing means of the suspension on the continuous trough bottom 16. But the fact that the trough shape almost has the characteristic of a bridge girder means that it is also possible to vertically vary the location of the fixing means if necessary because of particular space conditions, or the necessary free suspension member length.

Figure 8:
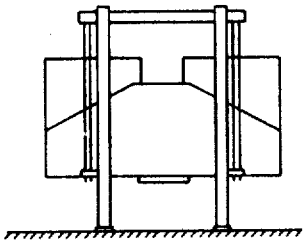
FIGS. 6, 7 and 8 show three ways of mounting the plansifter for free oscillation, with supporting props in FIG. 6 as in FIG. 1, or suspended from roof beams in FIG. 7 or from a frame structure in FIG. 8.
Figure 7:
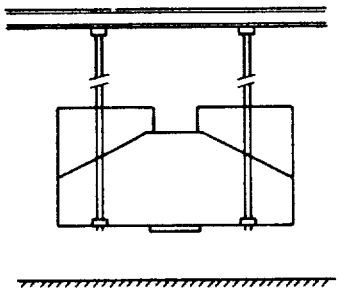
Figure 6:
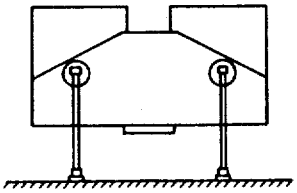

Versatility is regarded as one of the most significant surprising advantages. It has been possible for the first time to allow the choice of alternatives with regard to mounting by a suspended arrangement or with supporting props, or to offer the customer a choice of constructional configurations. While retaining many practical advantages, the same sifter can be mounted either as FIGS. 1–6 show, on elastic supports or, as FIGS. 7 and 8 show, suspended as a freely oscillating body from a frame, as in FIG. 8, or from roof members as in FIG. 7, as has been usual heretofore with large plansifters.

Without important price concessions, the sifter can also be used where only large plansifters were previously appropriate. Thus, more particularly, the invention also makes it possible to set up plansifters in buildings constructed in so-called hanger fashion, for example, in regions where there is a danger of earthquakes or in zones with regulations requiring such construction.

With the suspended constructional form it is possible to use either plastic material bars as described herein or the previously mentioned bamboo or like tubular bars. The plastic material bars are, however, suitable for both forms of mounting; that is to say, this construction makes it possible to supply them as part of a kit, allowing the choice of the final fixing method to be made in accordance with actual constructional constraints. As a freely oscillating body, such a small amount of oscillation force is transmitted to the exterior of the plansifter that it has been possible in test apparatus to anchor the plansifter during operation directly on a thick board floor. In the case of support from below the plansifter, previously unobserved phenomena, have been noted. For example, with the same power consumption of the motor and the same oscillation mass as in plansifters known in the art, a more attractive and slightly larger oscillation pattern is obtained with the supported embodiment.

It has not yet been possible to ascertain all relevant information, but possibly, in addition to the more efficient design, one of the reasons may be that, with the supported embodiment, the sifter is brought from a higher position of rest into a relatively low operating position. In the case of a suspended freely oscillating body the situation is exactly the reverse.

The embodiments described above eliminate many long existent deficiencies in plansifters. The solution which they provide makes it possible to construct a category of medium-size sifters with the constructional simplicity of small sifters but with all the operational advantages of large sifters. The customer can, for the first time, buy, for twice the price of a single-stack sifter, almost three times the sifting surface with the two stack sifters. He can choose an economically more advantageous intermediate sifter besides the single-stack sifter, which is still required for production purposes, and thus improve the economy of the entire mill installation.

Surprisingly, it has been found that the plansifters not only obviate the disadvantages mentioned earlier but also make it possible to open up new and advantageous methods of operating and constructional methods.

It has been shown by experiment that it is possible with the above sifter configuration to keep a single sieve stack in oscillation without causing any danger to personnel or equipment. The slight deviation of the oscillation pattern from the optimum circular path has no influence on the sifting performance.

What is claimed is:

1. A housing for a free swinging plansifter comprising a carriage (13) having a bottom (16), a pair of side walls (15), and a roof portion (18), interconnected to comprise a central drive casing (17) between a pair of troughs receiving and laterally bracing stacks of sieves, said side walls tapering outwardly in opposite directions from said roof portion to facilitate insertion and removal of said stacks of sieves from said troughs;

and means for mounting a vibration generator in said drive casing so as to apply to said bottom and said roof portion forces generally parallel to said bottom.

2. Free swinging plansifter with two stacks of sieves stacked in mutually spaced side-by-side relation on respective support floors, with a vibration generator having a rotating eccentric that is arranged between the stacks of sieves, and with a housing in which the support floors of the stacks of sieves are fastened for being set to vibration by the vibration generator, in which the housing (12) is constructed as a carriage (13) accommodating, at least in its lower regions, and there laterally bracing, the stacks of sieves (2,3) and also supporting a drive motor (40) for the vibration generator (41), said housing having a continuous housing floor (16) forming support floors for the stacks of sieves, and having side walls (15) sloping upwardly on their longitudinal sides, and being joined centrally by a transverse roof portion (18) to comprise a drive casing (17) integrated into housing (12), in which the vibration generator is installed in the region located between the stacks of sieves.

3. Plansifter in accordance with claim 2 in which the housing (12) and the side walls (15) slope out from the drive box (17) towards the ends of the housing and are constructed symmetrically.

4. Plansifter in accordance with claim 2 or claim 3, in which the drive motor (40) is attached to the housing floor (16).

5. Plansifter in accordance with claim 2 or claim 3, in which the side walls (15) extend to only about half the height needed for accommodating the stacks of sieves (2,3).

6. Plansifter in accordance with claim 2 or claim 3, in which the vibration generator (41) and its drive motor (40) are enclosed within the drive casing (17) and the drive casing (17) displays a height of about two-thirds the height needed for accommodating the stacks of sieves (2,3).

7. Plansifter in accordance with claim 2 or claim 3, in which there are attached, to the outer corners of side walls (15), perpendicularly arranged, preferably removable stack retaining rails (19) that extend over one-third to one-half the height needed for accommodating the stack.

8. Plansifter in accordance with claim 2 in which the vibration generator includes an unbalanced weight and means for adjusting the position of the effective center of mass of said weight in a direction generally normal to said bottom.

* * * * *